United States Patent [19]

Aoki

[11] Patent Number: 4,524,258

[45] Date of Patent: Jun. 18, 1985

[54] BACK-UP CONTROL CIRCUIT FOR CONTROLLING A MAGNETRON OF A MICROWAVE OVEN

[75] Inventor: Masayuki Aoki, Nagoya, Japan

[73] Assignee: Tokyo Shibaura Denki Kabushiki Kaisha, Kawasaki, Japan

[21] Appl. No.: 587,648

[22] Filed: Mar. 8, 1984

[30] Foreign Application Priority Data

May 27, 1983 [JP] Japan ..... 58-93706

[51] Int. Cl.[3] ..... H05B 6/68

[52] U.S. Cl. ..... 219/10.55 B; 219/508; 307/200 A; 361/86

[58] Field of Search ..... 219/10.55 B, 10.55 R, 219/490, 508; 361/86, 88; 307/200 A

[56] References Cited

U.S. PATENT DOCUMENTS 3,824,365 7/1974 Tapper ..... 219/10.55 B
4,011,428 3/1977 Fosnough et al. ..... 219/10.55 B
4,127,887 11/1978 Tanaka et al. ..... 361/86
4,295,027 10/1981 Zushi et al. ..... 219/10.55 B
4,409,635 10/1983 Kraus ..... 361/86 X
4,463,238 7/1984 Tanabe ..... 219/10.55 B

FOREIGN PATENT DOCUMENTS 57-208095 10/1982 Japan .

*Primary Examiner*—Philip H. Leung
*Attorney, Agent, or Firm*—Schwartz, Jeffery, Schwaab, Mack, Blumenthal & Evans

[57] ABSTRACT

A control circuit for controlling a magnetron of a microwave oven includes a microcomputer output control means for controlling the energy output of the microwave oven, and a means for controlling the magnetron in response to a time signal and a food temperature signal. The control circuit includes a back-up circuit to de-energize the magnetron when cooking is complete in the event of a malfunction of the microcomputer.

6 Claims, 7 Drawing Figures

BACK-UP CONTROL CIRCUIT FOR CONTROLLING A MAGNETRON OF A MICROWAVE OVEN

BACKGROUND OF THE INVENTION

This invention relates to a microwave oven and, more particularly, to a control circuit for controlling a magnetron of a microwave oven, which has a large scale integrated circuit.

Recently, it has been known to provide a control system for a microwave oven, including a programmable digital logic control circuit which enables a user to program information into the digital logic control circuit. An example of such a control system is shown in Fosnough et al U.S. Pat. No. 4,011,428 issued Mar. 8, 1977, entitled "Microwave Oven Timed and Control Circuit". A further example of a control system for a magnetron related to the programmable digital logic control circuit is disclosed in Zushi et al U.S. Pat. No. 4,295,027 issued Oct. 13, 1981, entitled "Microwave Ovens with Programmable Control".

In the above teaching, the microwave oven has a control circuit which memorizes a time for cooking and a cooking temperature for the food being cooked based on information supplied by the user. If the cooking time has elapsed, or the food reaches the predetermined cooking temperature, the microwave oven stops operating.

Moreover, the control circuit of the microwave oven functions to control the heating output by a key button on the control panel. In this operating mode, the microwave oven operates to cook the food according to a predetermined output. Also the microwave oven has a display function for displaying the predetermined cooking time, temperature, and energy output level, and the remaining cooking time, and temperature of food during cooking using LED display means.

Microwave ovens without digital logic circuits are readily available and generally have a low purchase price. These ovens have a mechanical timer for cooking and a mechanical output controller for controlling the microwave energy output, as shown in U.S. Pat. No. 3,824,365, issued on July 16, 1974.

It is advantageous for the low-cost ovens to also have the digital control circuits in order to operate with the above-mentioned temperature and output control functions.

A conventional microwave oven of this type is shown in FIGS. 1, 2 and 3.

Referring to FIG. 1, a body 1 has a door 2 and a front panel 3 located on a front face of the body 1. The door 2 is pivotally hinged at one side of the body 1. The front panel 3 has a sliding knob 4, a temperature control knob 5, a timer knob 6, and a start button 7. The microwave output energy is set by the sliding knob 4. Reference numeral 8 is a cook indicator lamp. A heating chamber (not shown) is constructed in the body 1 adjacent the door 2. The microwave energy is provided from a magnetron into the heating chamber to heat food products placed therein. A temperature detector, such as a temperature-sensing probe, is provided in the heating chamber to detect the temperature of the food.

FIG. 2 illustrates a circuit configuration of the control system of the microwave oven including the digital logic circuit. The circuit configuration mainly comprises a commercial power source 10, a magnetron 20 and a control unit 30.

The commercial power source 10 is connected to a primary winding 12*a* of the high voltage transformer 12 through a fuse 14, a door switch 16, a triac 18, and a relay contact 19*a* of a relay 19*b*. A secondary winding 12*b* of the transformer 12 is connected to the magnetron 20. Reference numeral 22 is a door monitor switch which is opened when the door is closed.

The power source 10 is also connected to a primary winding 24*a* of a voltage transformer 24 through the fuse 14. A secondary winding 26*b* of the transformer 26 is connected to the control unit 30.

The control unit 30 employs food temperature control of food to be cooked. The control unit 30 is connected to a temperature-sensing probe 32, a mechanical timer motor 6M, the relay 19*b*, and the triac 18. The temperature-sensing probe 32 comprises a thermometer 32*a*, which is removably connected to the control unit 30 by a sliding contactor 32*b* positioned at the wall of the heating chamber. The mechanical timer motor 6M is set with the desired cooking time by turning the timer knob 6. Reference numeral 6*a* is a timer contactor of the timer motor 6M. Contactor 6*a* closes when a cooking time is set by means of timer knob 6. Contactor 6*a* opens in response to the timing out of timer motor 6M.

Reference numerals 4R and 5R show variable resistors which change the microwave energy output and the set cooking temperature of the food in response, respectively, to the sliding knob 4 and the temperature control knob 5.

The triac 18 is turned ON or OFF by a signal from the control unit 30 according to the variable resistor 4R. Contactor 7*a* is turned ON to start the cooking process in response to depression of the starting button 7.

FIG. 3 shows a more detailed schematic of the control unit and associated circuitry. An output control means 40 is made of a large scale integrated circuit 40. LSI circuit 40 may comprises a microcomputer, as, for example, NEC PD550C. The contactor 7*a* produces a starting signal A for the LSI circuit 40, if the starting button 7 is pushed. After setting up a cooking time, the contactor 6*a* produces a cooking time signal B for the LSI circuit 40.

The variable resistor 5R provides operational amplifier (op-amp) 42 with a temperature setting signal from the variable terminal thereof. The thermometer 32*a* provides op-amp 42 and op-amp 44 with a signal representative of the food temperature.

Additional resistors are utilized to regulate the signals, as shown in FIG. 3. Vcc and Vd indicate fixed DC voltages generated from circuitry including the transformer 24.

A temperature-detecting signal C is provided for the LSI circuit 40 from the op-amp 42. Probe signal D is provided for the LSI circuit 40 from the op-amp 44.

Relay coil 19*b* is connected with npn-type transistor 46 through a resistor. If transistor 46 is turned ON by the control signal E of the LSI circuit 40, the relay coil 19*b* actuates the relay contactor 19*a* to close the circuit.

Accordingly, the control unit 30 controls the output of the microwave energy by producing the control signal E for the relay 19 according to the signals A, B, C, and D.

However, the control unit 30 may not operate properly if the LSI circuit 40 malfunctions. In this case, the microwave oven may not turn off even though the cooking time has expired or the predetermined cooking temperature has been reached. In such cases, it is dangerous for the microwave oven to continue operation after expiration of the cooking time.

SUMMARY OF THE INVENTION

It is a primary object of the present invention to provide an improved control circuit for a magnetron of a microwave oven.

More particularly, it is another object of the invention to provide a means for controlling the microwave oven even if the LSI control means of the microwave oven malfunctions.

It is a further object of the invention to provide a back-up magnetron cut-off control means for controlling the de-energization of the microwave oven, wherein the means is constructed of digital logic gate circuits distinct from the LSI control means, which itself may malfunction and fail to provide the necessary microwave energy de-energization.

The control circuit for controlling a magnetron of a microwave oven of the invention comprises a high voltage transformer, a relay switching means provided between the transformer and a power source, an output control means, and a means for controlling the magnetron.

The microwave oven has a mechanical timer and a means for detecting food temperature. The output control means comprises a large scale integrated circuit and produces control signals for controlling the microwave energy output. The means provided between the relay switching means and the output control means controls the magnetron according to a time signal and a food temperature signal, regardless of whether or not the control signal is present.

BRIEF DESCRIPTION OF THE DRAWINGS

Features of the present invention will be apparent from the following drawings, wherein.

DETAILED DESCRIPTION OF THE PREFERRED EMBODIMENTS

Figure 4:
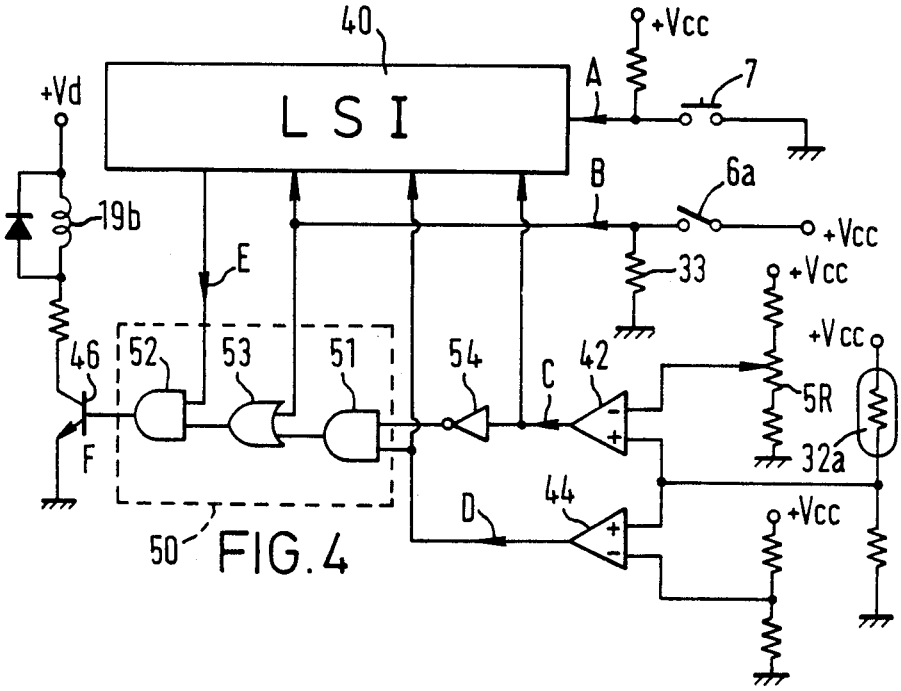
FIG. 4 is a schematic circuit diagram of the control circuit of the invention.

Referring now more specifically to the drawings, wherein like reference numerals designated like elements in the several figures, a first preferred embodiment of the present invention is shown in FIG. 4.

Figure 1:
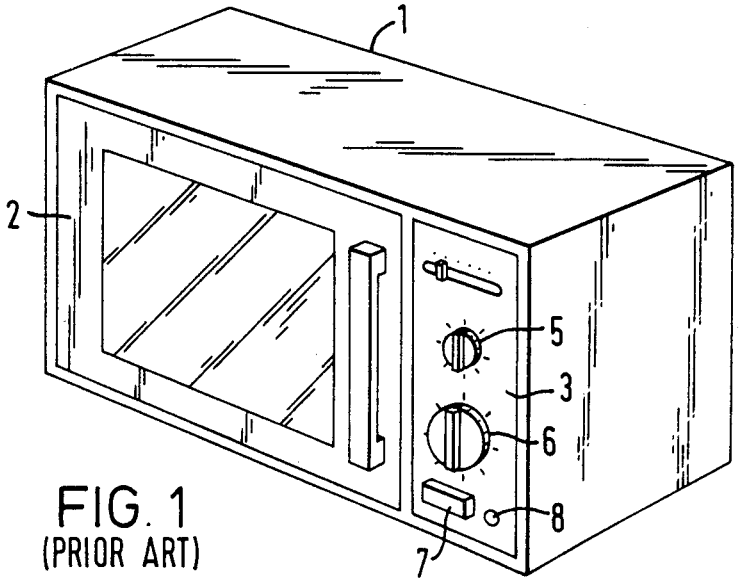
FIG. 1 (PRIOR ART)
FIG. 1 is a perspective view of a conventional microwave oven.
Figure 2:
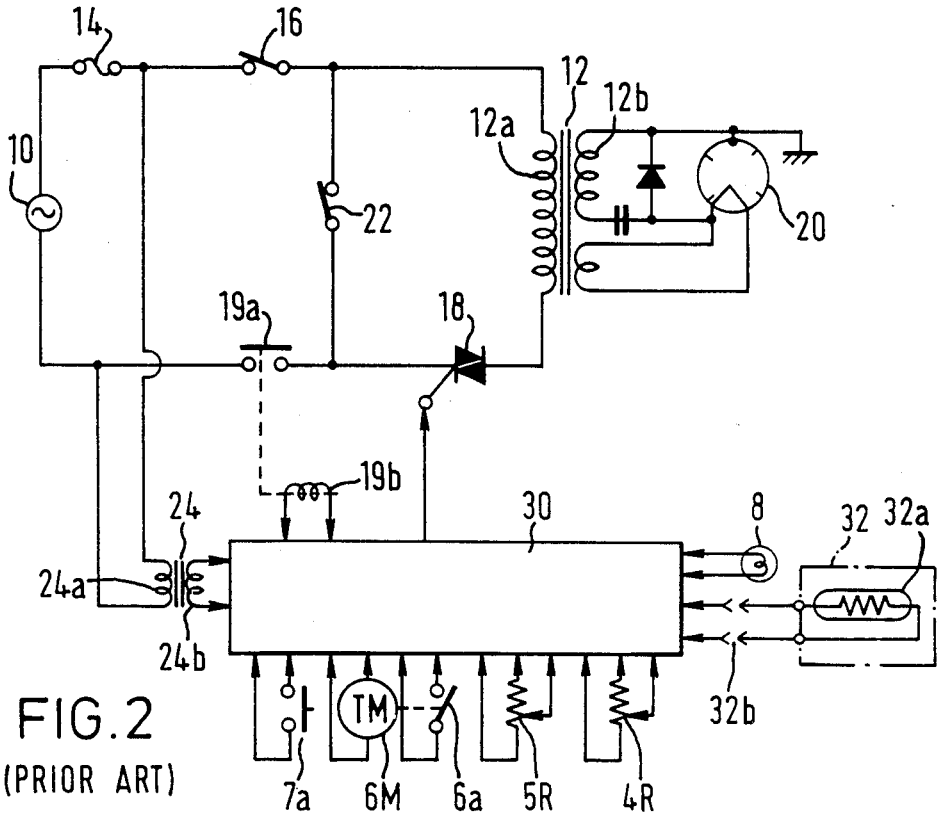
FIG. 2 (PRIOR ART)
FIG. 2 is a circuit configuration for a microwave oven employing the conventional control circuit.
Figure 3:
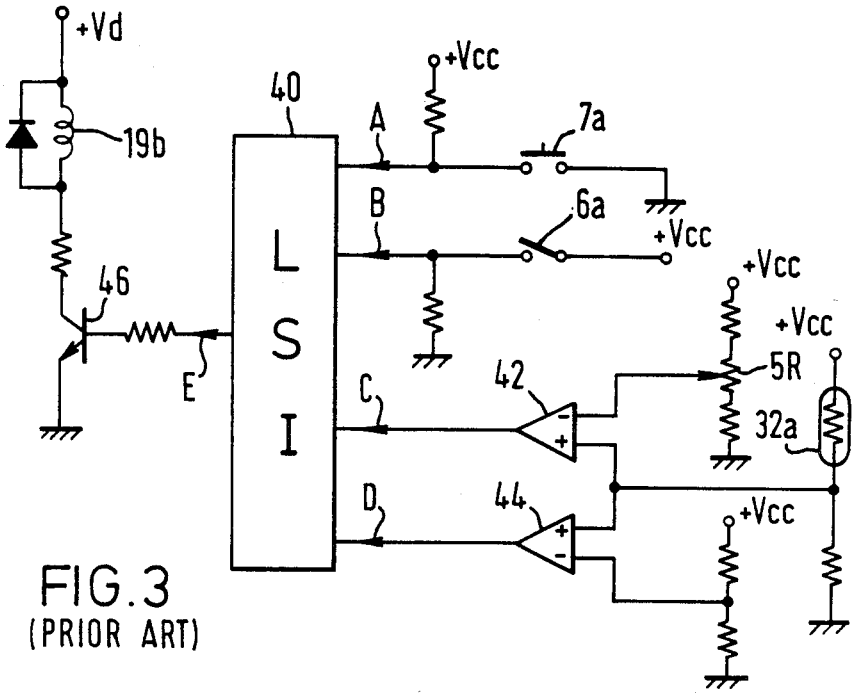
FIG. 3 (PRIOR ART)
FIG. 3 is a detailed control circuit diagram of a prior art control circuit for a microwave oven.

The control circuit utilizes many components of the conventional control circuit of FIGS. 2 and 3; namely, the high voltage transformer 24, a relay switching means 19 and LSI circuit 40. The control circuit in accordance with the invention utilizes a digital logic gate circuit means 50 for controlling the magnetron 20 by means of the relay switching means 19.

Circuit means 50 has two AND-gates 51, 52 and an OR-gate 53. Temperature-detecting signal C is fed to LSI circuit 40 and is further provided to AND-gate 51 through an inverter 54. Probe signal D is provided to AND-gate 51 as well as LSI circuit 40. OR-gate 53 receives the output signal of AND-gate 51 and cooking time signal B. The output signal of OR-gate 53 is fed to AND-gate 52 which also receives an input control signal E from LSI circuit 40. The output signal F of AND-gate 52 is provided to transistor 46 which is conected in series with the relay coil **19*b*** through a resistor.

Figure 5:
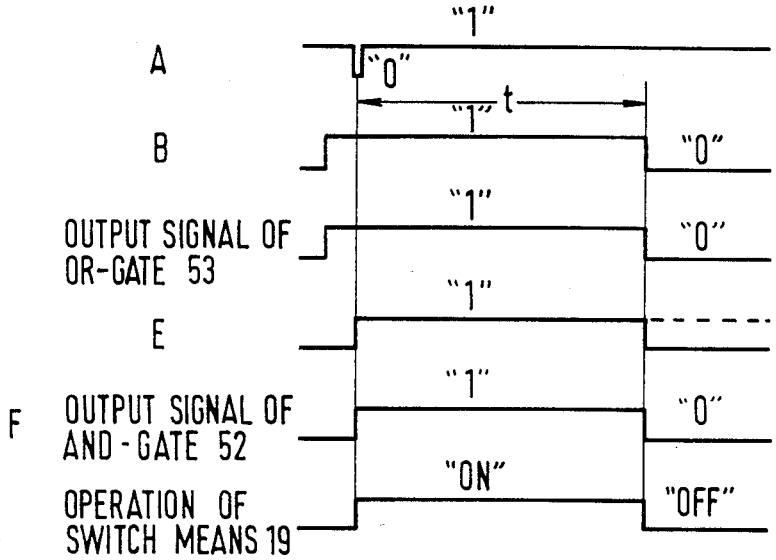
FIG. 5 is a graph showing various waveforms for describing the operation by the timer function of the control circuit shown in FIG. 4.

The cooking time operating circuitry is described in relation to FIG. 5. First, the microwave energy output is determined by means of setting sliding knob 4. The cooking time is then set via timer knob 6. Upon setting timer knob 6, timer contactor **6*a* turns on, and timer signal B turns logic "1". The operator next depresses the spring-biased start button 7 which momentarily causes starting signal A to turn logic "0" from its normal logic "1" state. LSI circuit 40 then starts to operate the timer motor 6M and turns control signal E to logic "1". The output signal of AND-gate 51 is a logic "0", as the probe 32 is not used. The output signal of OR-gate 53 is a logic "1", since time signal B is a logic "1". Accordingly, AND-gate 52 outputs an output signal F as a logic "1". Transistor 46 turns on to operate relay 19*b* which closes contact 19*a*. As a result, magnetron 20 is energized to start the cooking process. The output of the microwave oven is controlled by LSI circuit 40 through triac 18 according to the setting of variable resistor 4R**.

When the predetermined cooking time has expired, timer contactor **6*a* opens and time signal B turns to a logic "0". Thus, LSI circuit 40 de-energizes timer motor 6M, and turns control signal E to a logic "0". Accordingly, signal F from the output of AND-gate 52 becomes a logic "0". Transistor 46 turns off to stop operating relay 19*b*, thus opening contact 19*a* and de-energizing magnetron 20**.

It may be understood, that in normal operation, when LSI circuit 40 operates properly, the transition of output signal F from a logic "1" to a logic "0" operates as a magnetron cut-off signal. If LSI circuit 40 malfunctions, control signal E continues to be a logic "1" (as shown by dot line in FIG. 5) even though the predetermined cooking time t has expired. In accordance with the invention, however, the output signal of OR-gate 53 is a logic "0", as both time signal B and the output signal of AND-gate 51 are logic "0". Thus, the final output signal F transitions to become a logic "0" which de-energizes magnetron 20 even though control signal E continues to be a logic "1". The control means 50 may thus be considered to supply a back-up magnetron cut-off control signal.

Figure 6:
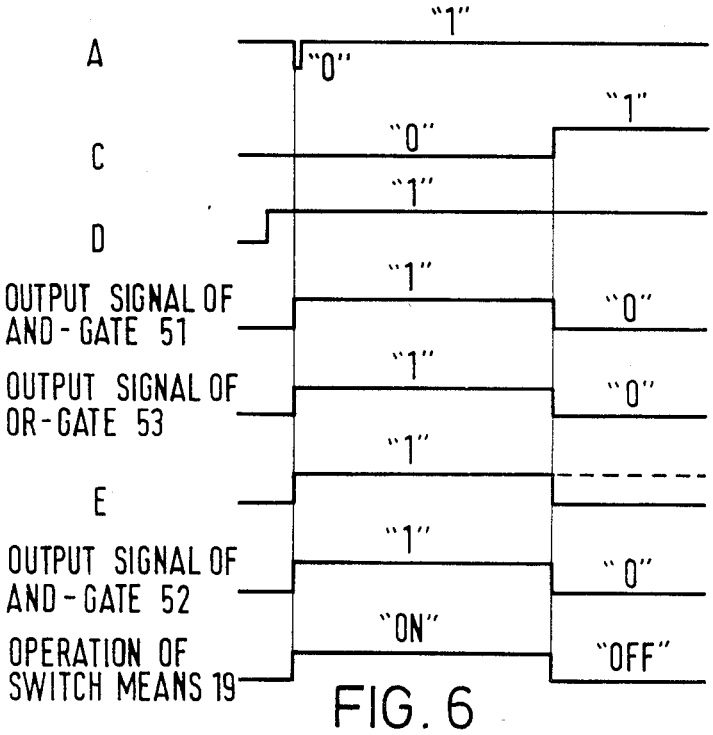
FIG. 6 is a graph showing various waveforms for describing the operation by the temperature function of the control circuit shown in FIG. 4.

The temperature function of the control circuit is described in reference to FIG. 6. The output signal from probe 32 is fed to the control circuit of the microwave oven, and the probe itself is inserted in the food to be cooked. The predetermined cooking temperature is set using temperature knob 6. Whenever the thermometer **32*a* is utilized, i.e., connected to the control circuit, a probe signal is generated which passes to op-amp 44 and is provided as a logic "1" signal D to LSI circuit 40. For this purpose, the inverting input terminal of op-amp 44 receives a relatively low reference voltage from the voltage divider resistor chain connected thereto, and the thermometer 32*a* provides a greater voltage than the reference voltage, even at non-elevated temperatures. LSI circuit 40** receives the probe signal D and changes the operating control mode from a timer function to a temperature function. Therefore, LSI circuit operates only in the temperature function mode, even if both the timer is set and the prove is inserted.

Temperature-detecting signal C is a logic "0", whenever the temperature of the food is lower than the predetermined temperature. Op-amp 42 produces a logic "1" when the temperature of the food is equal to or greater than the predetermined temperature.

When start button 7 is depressed to start the cooking operation, starting signal A momentarily turns to a logic "0", and LSI circuit 40 outputs control signal E as a logic "1". The output signal of OR-gate 53 is a logic "1", as both the probe signal D and the output signal of inverter 54 are logic "1". Thus, final output signal F is a logic "1", and cooking starts. If the food temperature rises above the predetermined temperature, control signal E becomes a logic "0" in response to the resistor value of thermometer 32*a* changing in accordance with the food temperature. Therefore, final output signal F is a logic "0", and cooking is completed.

If, however, LSI circuit 40 malfunctions, control means E continues to be a logic "1", as shown by the dotted line in FIG. 6. Now, if the food temperature rises above the predetermined temperature, the temperature signal C becomes a logic "1" via op-amp 42, and the output signals of AND-gate 51 and OR-gate 53 are logic "0". Accordingly, the final output signal F is a logic "0", even through control signal E is a logic "1". Magnetron 20 is thus de-energized, and cooking is completed.

Figure 7:
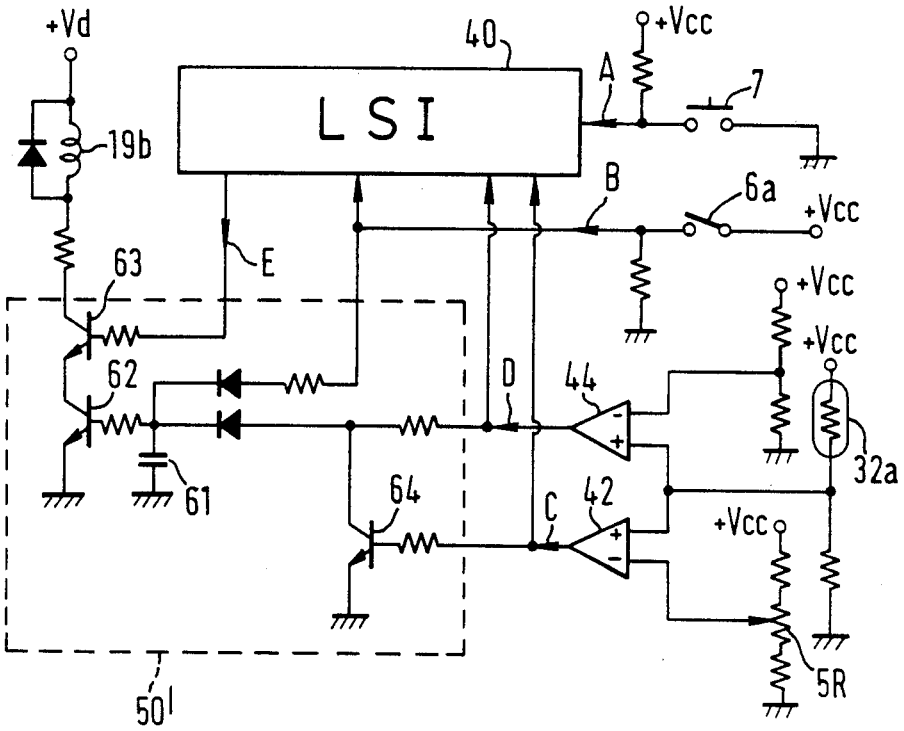
FIG. 7 is a schematic diagram of another embodiment of the control circuit of the invention.

FIG. 7 shows another embodiment of the invention. In this embodiment, control means 50' operates similarly as control means 50, but is fabricated from different electronic components. Control means 50' comprises condensor 61, transistors 62 and 63, and diodes and resistors as shown.

In operation, if signal B is a logic "1", condensor 61 is charged to turn transistor 62 on. As before, signal E becomes a logic "1" when start button 7 is momentarily closed. Therefore, transistors 62, 63 turn on and operate relay 19*b*. The magnetron 20 is energized through switching means 19. Magnetron 20 is de-energized when signal B is a logic "0", even if signal E is a logic "1".

In the temperature function mode, if the temperature of the food rises to the predetermined temperature, signal C becomes a logic "1" to turn the transistor 64 on. When transistor 64 turns on, transistor 62 turns off to de-energize magnetron 20.

In summary, this invention is directed toward a microwave oven having a control means for controlling the output of the magnetron, a mechanical timer, and means for detecting food temperature to control the magnetron. The invention further has a safety means for stopping energization of the magnetron according to the timer and temperature signals, even if the control means (LSI) malfunctions, so as not to itself effect de-energization of the magnetron.

While the invention has been described in reference to preferred embodiments, it will be understood by those skilled in the art that various modifications may be made without departing from the spirit and scope of the invention as set forth in the appended claims.

What is claimed is:

1. A control circuit for controlling a microwave oven having a mechanical timer providing a time signal and food temperature detecting means for providing a food temperature signal, said control circuit comprising:

a magnetron;

a high voltage transformer electrically connected to said magnetron;

relay switching means, for connecting said transformer with a power source;

output control means, including a large scale integrated circuit responsive to said time signal and said food temperature signal, for producing a control signal to control said relay switching means; and means, provided between said relay switching means and said output control means, for controlling the relay switching means in response to said control signal, said time signal, and said food temperature signal, said time and food temperature signals connected as direct inputs to said controlling means and said controlling means operative for generating a magnetron cut-off signal for operating said relay switching means to disconnect said transformer from said power source for stopping energization of the magnetron when cooking is completed.

2. A control circuit for according to claim 1, wherein said relay switching means includes a relay contactor connected between the power source and said transformer, and a relay coil responsive to the magnetron cut-off signal of said controlling means.

3. A control circuit according to claim 1, further including a triac connected in circuit with said transformer, and wherein said output control means controls the microwave energy output of said magnetron by controlling said triac.

4. A control circuit according to claim 1, wherein said means for controlling the magnetron comprises digital logic gate circuits.

5. A control circuit for controlling the magnetron according to claim 1, wherein said magnetron cut-off signal is fed to said relay switching means to stop energization of the magnetron in response to either one of the time signal and the food temperature signal.

6. A control circuit for controlling a magnetron of a microwave oven comprising:

(a) a timer providing a timing signal upon expiration of a settable time period;

(b) a temperature measuring device producing a temperature signal in response to the temperature of food products, placed within said oven, reaching a settable temperature;

(c) an LSI control device normally operative to receive said timing signal and said temperature signal and to produce a magnetron cut-off control signal in response to either one of said timing and temperature signals and, during malfunction, not providing said magnetron cut-off control signal; and (d) a back-up circuit connected to receive said magnetron cut-off control signal, said time signal and said temperature signal for producing a back-up magnetron cut-off control signal during malfunction of said LSI and in response to either one of said time and temperature signals.

* * * * *